US006521400B1

(12) United States Patent
Dannhauser et al.

(10) Patent No.: US 6,521,400 B1
(45) Date of Patent: Feb. 18, 2003

(54) IMAGE MODIFICATION IN COLOR REVERSAL PHOTOGRAPHIC ELEMENTS

(75) Inventors: Thomas J. Dannhauser, Pittsford, NY (US); Phillip D. Knight, Fairport, NY (US); Thomas R. Welter, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/590,483

(22) Filed: Jun. 8, 2000

(51) Int. Cl.[7] ..... G03C 1/34

(52) U.S. Cl. ..... 430/544; 430/547

(58) Field of Search ..... 430/544, 547

(56) References Cited

U.S. PATENT DOCUMENTS

| | | | | |
|---|---|---|---|---|
| 3,536,487 A | | 10/1970 | Graham | 430/504 |
| 3,674,478 A | | 7/1972 | Grasshoff et al. | 430/219 |
| 3,730,724 A | | 5/1973 | Abbott | 430/505 |
| 4,248,962 A | | 2/1981 | Lau | 430/382 |
| 4,350,752 A | | 9/1982 | Reczek et al. | 430/219 |
| 4,478,929 A | | 10/1984 | Jones et al. | 430/217 |
| 4,684,604 A | | 8/1987 | Harder | 430/375 |
| 4,845,020 A | | 7/1989 | Itoh et al. | 430/445 |
| 4,861,701 A | * | 8/1989 | Burns et al. | 430/543 |
| 5,019,492 A | | 5/1991 | Buchanan et al. | 430/543 |
| 5,041,367 A | | 8/1991 | Sniadoch | 430/603 |
| 5,116,717 A | | 5/1992 | Matsushita et al. | 430/264 |
| 5,380,633 A | | 1/1995 | Harder et al. | 430/505 |
| 5,411,839 A | | 5/1995 | Harder et al. | 430/379 |
| 5,567,577 A | | 10/1996 | Welter et al. | 430/544 |

FOREIGN PATENT DOCUMENTS

| | | |
|---|---|---|
| EP | 255 085 | 2/1988 |
| JP | 4 040 450 | 2/1992 |
| JP | 7 311 433 | 11/1995 |
| JP | 7 311 437 | 11/1995 |
| JP | 10 282 616 | 10/1998 |
| JP | 11 327 102 | 11/1999 |

OTHER PUBLICATIONS

U.S. patent application Ser. No. 09/060,802, filed Apr. 15, 1998, titled "Photographic Elements Containing Release Compounds", of Vargas et al.

* cited by examiner

*Primary Examiner*—Hoa Van Le
(74) *Attorney, Agent, or Firm*—Andrew J. Anderson

(57) ABSTRACT

A multilayer color reversal photographic film element is described containing at least two silver halide photographic emulsion layers and a compound of the formula F-1:

F-1 wherein A, B, C, and D are independently substituted or unsubstituted aliphatic, alicyclic, aromatic or heterocyclic substituents, which may where structurally possible together form a ring or rings; where at least one of A, B, C, and D is of the formula F-2:

F-2 wherein $R^1$ and $R^2$ are independently either hydrogen or substituted or unsubstituted aliphatic, alicyclic, aromatic or heterocyclic substituents, which may where structurally possible form a ring with other substituents; $R^3$ is a substituted or unsubstituted aliphatic, alicyclic, aromatic or heterocyclic substituent which may where structurally possible form a ring with other substituents, L is a bivalent linking or timing group attached to the carbonyl moiety via a heteroatom, n varies from 0–2; and INH is a silver development inhibitor attached either to an L or the carbonyl moiety via a heteroatom.

20 Claims, No Drawings

IMAGE MODIFICATION IN COLOR REVERSAL PHOTOGRAPHIC ELEMENTS

FIELD OF THE INVENTION

This invention relates to silver halide photographic elements. In particular, it relates to color reversal photographic elements containing release compounds which provide a non-imagewise distribution of an image-modifying compound.

BACKGROUND OF THE INVENTION

Conventional color photographic images are formed via a chromogenic development process comprising reaction of oxidized silver halide developing agent and dye precursors known as color couplers. After exposure of a color photographic element, the object scene is typically stored as a composite of red, green and blue latent silver halide images. During processing, these images or related reversal silver halide images are reductively developed in presence of a phenylenediamine color developer. Oxidized developer produced under these conditions reacts with the conjugate base of cyan, magenta or yellow dye-forming couplers to give their respective dyes. The composite dye image is then formed by the superpositioning of the cyan, magenta and yellow dye images to afford a reproduction of the original scene.

Color reproduction and image sharpness are important features of photographic reproductions. The color reproduction of conventional photographic system is primarily controlled by the hues of the cyan, magenta and yellow dyes that comprise the color image. Such image dyes, while generally reproducing a wide range of colors accurately, are never ideal; imperfections in the spectral characteristics of these dyes lead to degraded color reproduction. Thus, a yellow dye that absorbs too much green light appears orange and cannot effectively reproduce bright yellows, e.g. lemons. This yellow dye in combination with an effective magenta dye affords desaturated red colors, e.g. flowers or textiles.

In forming photographic images, it has become relatively common practice in the art to incorporate image-modifying compounds into either the developing solutions or the photographic materials themselves. These image-modifying compounds can impact such photographic properties as sharpness, granularity, contrast and color reproduction. Major changes in color reproduction can be obtained via alterations in the chemical nature of the image dye couplers, but a more subtle color correction mechanism is often employed: interlayer interimage effects (IIE). IIE occurs when the development process of one color record changes that of one or more of the other records. The most typical application of IIE for color correction is to inhibit the formation of one dye in response to the formation of another. In the case of the de-saturated red colors mentioned above, the imperfect yellow dye absorbs some green light, thus, less than a theoretical amount of magenta dye is needed for adequate red color reproduction. During the design of modern films, mechanisms for such IIE's have been perfected. Most typically a development inhibitor, perhaps iodide from the emulsion or an organic development inhibitor derived from a development. inhibitor releasing (DIR) coupler, are produced in one layer (the causing layer); this inhibitor, upon migration to another imaging layer (the receiver layer), suppresses development to eventually yield the desired color reproduction effect.

Negative materials are processed, after image exposure, directly with a chromogenic developer which color-develops the negative exposed areas. Positive dye image-forming reversal photographic materials, on the other hand, after imagewise exposure, are first processed with a black-and-white developer which develops a silver image in the negative exposed areas. This is followed by a reversal fogging step (e.g., a second overall exposure or a chemical fogging step) and then development with a chromogenic developer to form a positive color image. In negative dye image-forming photographic materials, interimage effects are always obtained during chromogenic development. In positive dye image-forming reversal photographic materials, interimage effects are generally obtained during processing by the release in the first black-and-white developer of a development inhibitor as a function of the silver development of the image-forming layers. The most generally used development inhibitor consists of iodide ions released as a result of the development of silver haloiodide, for example, silver bromoiodide emulsions.

In some color reversal films IIE's derived from inhibition in the black-and-white development step can be amplified via the inclusion of certain chemical addenda; often 4-carboxymethyl-2-mercaptothiazole (CMMT, CAS #36365-79-4) or related compounds are employed in this manner.

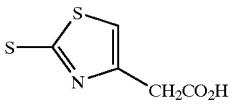

CMMT

Frequently the beneficial effects of the presence of silver development inhibitors comes with a loss in photographic speed, due to losses incurred during the inhibition of emulsion development or via the interaction of the coated inhibitor with the photographic emulsion. The inclusion of CMMT or similar development inhibitors in color reversal films improves the color reproduction and sharpness of the image but with a substantial speed penalty. Direct incorporation of image-modifying compounds into photographic materials also often leads to unacceptable image reproduction as such compounds can prematurely interact with other components of the photographic elements, or can decompose during shelf keeping. Thus, methods for the incorporation of development inhibitors into photographic films that circumvent these disadvantage are of particular interest.

It has become accepted to attach image-modifying compounds to coupler moieties and to have them released in an imagewise manner during development of the photographic material. This, however, has the dual disadvantage of requiring image formation (as the coupler moiety reacts with oxidized developer) whenever the presence of an image-modifying compound is desired, and of providing only an imagewise release of the image-modifying compound. Materials that afford imagewise delivery of inhibitors during reversal black and white development, often termed inhibitor releasing developers (IRD's), have also been described previously (e.g. U.S. Pat. Nos. 4,636,456, 5,210,012, 5,310,638, 5,541,044,5,578,441, and 5,756,274; JP Kokai 11-327102). While potentially providing valuable photographic improvements, the useful embodiments of this technology are disadvantageous in two regards. Firstly, these compounds are oxidatively unstable, shortening product shelf life. Aerial oxidation of IRD's, during film storage, can initiate a chain of reactions leading to the premature release of development inhibitor that degrades photographic behavior. This is similar to the disadvantage of direct incorporation of development inhibitors describe above. Secondly, the imagewise delivery of the inhibitor by oxidative consumption of the IRD during development, by its very mechanism, necessitates the presence of residual IRD in the film after development. This residue when carried into the color developer can itself afford two disadvantages. First, the IRD can reductively consumed oxidized color developer leading to reduced image dye formation. In the second place, the residual IRD now provides delivery of a development inhibitor during the color development step; this release can limit or slow chromogenic development perhaps leading to reduced image dye formation or to an increased sensitivity of the film to processing solution variability.

There are known alternative means for incorporating image-modifying compounds into various types of photographic materials. Image modifying compounds have been inactivated by blocking as disclosed in, for example, U.S. Pat Nos. 3,674,478, 4,350,752, 4,478,929, 4,684,604, 5,019,492, 5,116,717, and 5,567,577; EP 0 255 085; and JP Kokai 7-311437. Although some of the blocked or timed inhibitors known in the art are capable of impacting photographic properties primarily during the initial black and white development step of reversal processing, at certain levels or in certain photographic elements, the may be inadequate for completely controlling color balance. While the use of certain quinone based blocked inhibitor compounds is conventional in dye image transfer film systems as disclosed, e.g., in U.S. Pat. No. 4,478,929, there is no suggestion such compounds may be advantaeously used in color reversal materials. Similarly, While JP Kokai 7-311437 suggests the use of development inhibitor releasing quinone compounds in a graphic arts silver halide product, there is no suggestion such compounds may be advantageously used in color reversal materials.

SUMMARY OF THE INVENTION

It is an object of the present invention to provide color reversal photographic materials comprising blocked image-modifying compounds that are unblocked in a non-imagewise manner and that provide adequate control over image modification.

In accordance with one embodiment of the invention, a multilayer color reversal photographic film element is described containing at least two silver halide photographic emulsion layers and a compound of the formula F-1:

F-1

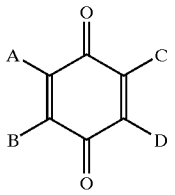

wherein A, B, C, and D are independently substituted or unsubstituted aliphatic, alicyclic, aromatic or heterocyclic substituents, which may where structurally possible together form a ring or rings; where at least one of A, B, C, and D is of the formula F-2:

F-2

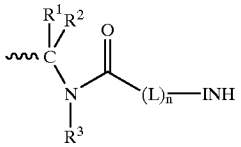

wherein $R^1$ and $R^2$ are independently either hydrogen or substituted or unsubstituted aliphatic, alicyclic, aromatic or heterocyclic substituents, which may where structurally possible form a ring with other substituents; $R^3$ is a substituted or unsubstituted aliphatic, alicyclic, aromatic or heterocyclic substituent which may where structurally possible form a ring with other substituents, L is a bivalent linking or timing group attached to the carbonyl moiety via a heteroatom; n varies from 0–2; and INH is a silver development inhibitor attached either to an L or the carbonyl moiety via a heteroatom. In preferred embodiments, $R^1$ and $R^2$ are hydrogen or lower alkyl groups of from 1 to 4 carbon atoms, $R^3$ is an alkyl group (more preferably primary alkyl group) of from 1–12 carbon atoms, and A, B, C and D substituents which are not of structure F-2 are preferably alkyl or aryl groups of from 1–20 carbon atoms. A second embodiment of the invention comprises subjecting a color reversal film as described above after imagewise exposure to a color reversal process comprising a first black and white development step which develops a silver image in negative exposed areas, a reversal fogging step, and then development with a chromogenic developer to form a positive color image.

It has been found that use of the benzoquinone derivatives of Formula F-1, capable of redox-derived release of development inhibitors, can afford improved acutance and color of reversal films. These improvements resulting from the use of inhibitor releasing quinone (IRQ) compounds come at a lower speed penalty than that from the directly incorporated development inhibitor, and provide an alternative mechanism by which development inhibitors can be released in a non-imagewise manner during color reversal processing. Potential problems related to the use of IRD's are also circumvented. The IRQ compound incorporates the development inhibitor into the film as an oxidized substrate with good shelf life, particularly with regard to aerial oxidation. The non-imagewise delivery of inhibitors from this technology during black and white development is not mechanistically constrained to leave residual amounts of unconsumed masked inhibitor remaining in the film.

DETAILED DESCRIPTION OF THE PREFERRED EMBODIMENTS

Photographic film elements in accordance with the invention contain a compound of the formula F-1:

F-1

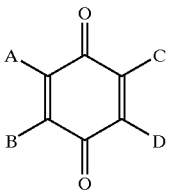

wherein A, B, C, and D are independently substituted or unsubstituted aliphatic, alicyclic, aromatic or heterocyclic substituents, which may where structurally possible together form a ring or rings; wherein at least one of A, B, C, and D is of the formula F-2:

F-2

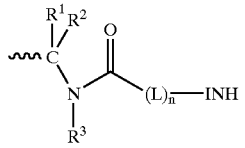

wherein $R^1$ and $R^2$ are independently either hydrogen or substituted or unsubstituted aliphatic, alicyclic, aromatic or heterocyclic substituents, which may where structurally possible form a ring with other substituents; $R^3$ is a substituted or unsubstituted aliphatic, alicyclic, aromatic or heterocyclic substituent which may where structurally possible form a ring with other substituents, L is a bivalent linking or timing group attached to the carbonyl moiety via a heteroatom; n varies from 0–2; and INH is a silver development inhibitor attached either to an L or the carbonyl moiety via a heteroatom.

Representative aliphatic, alicyclic, aromatic or heterocyclic substituents for groups A, B, C, D, $R^1$, $R^2$, and $R^3$ include primary, secondary, and tertiary alkyl groups, cycloalkyl groups such as cyclopentyl and cyclohexyl, phenyl and naphthyl groups, and heterocyclic groups such as pyridyl, furanyl, pyrrolyl, piperidinyl. In preferred embodiments, $R^1$ and $R^2$ are hydrogen or lower alkyl groups of from 1 to 4 carbon atoms, $R^3$ is an alkyl group (more preferably primary alkyl group) of from 1–12 carbon atoms, and A, B, C and D substituents which are not of structure F-2 are preferably alkyl or aryl groups of from 1–20 carbon atoms.

L is a linking or timing group that, upon activation or timing, is capable of releasing the INH. Such timing groups are well known in the art, and representative timing groups are as described, e.g., in Research Disclosure No. 36544 (1994) pg. 525 and U.S. Pat. No. 5,474,886, the disclosures of which are incorporated herein by reference.

INH is a releasable inhibitor compound. When incorporated in the inhibit or releasing quinone compound F-1 in a deactivated form, such compounds provide both good shelf life and controlled release into developing emulsion, via chemical interaction between the F-1 compound and a reductive developer bath. INH compounds may include any of a variety of known development inhibitors, such as are described in such representative patents as U.S. Pat. No. 3,227,554; U.S. Pat. No. 3,384,657; U.S. Pat. No. 3,615,506; U.S. Pat. No. 3,617,291, U.S. Pat. No. 3,733,201 and U.K. Patent 1,450,479 (also see T. H. James, in *The Theory of the Photographic Process*, 4th Ed., Macmillan, New York, 1977, chapter 13J; and *Research Disclosure*, December 1989, Item No. 308911, Section VI and references therein). Preferred INH compounds are heterocyclic compounds such as mercaptotetrazoles, selenotetrazoles, mercaptobenzothiazoles, selenobenzothiazoles, mercaptobenzoxazoles, selenobenzoxazoles, benzotriazoles, and benzodiazoles, mercaptooxadiazoles, mercaptothiadiazoles, and mercaptothiazoles. General structures of preferred development inhibitors INH include:

INH-1

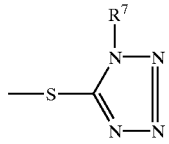

INH-2

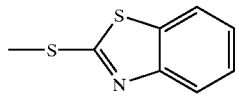

INH-3

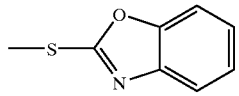

INH-4

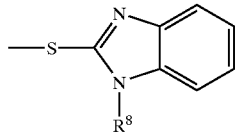

INH-5

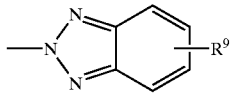

INH-6

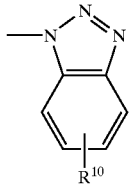

INH-7

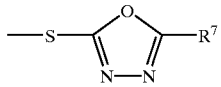

INH-8

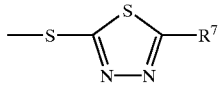

INH-9

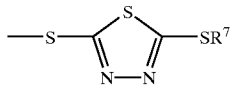

INH-10

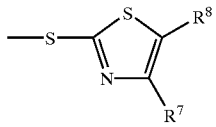

where $R^7$ and $R^8$ are individually hydrogen, a substituted or unsubstituted alkyl (preferably of 1 to 8 carbon atoms, for example, methyl, ethyl, butyl) or phenyl group, and $R^9$ and $R^{10}$ are individually hydrogen or one or more halogen (for example, chloro, fluoro, bromo), alkyl (preferably of 1 to 4 carbon atoms), carboxyl, carboxy esters (such as $—COOCH_3$), $—NHCOOCH_3$, $—SO_2OCH_3$, $—OCH_2CH_2SO_2CH_3$, $—OC(O)OCH_2CH_3$, $—NHC(O)C(O)OCH_3$ or nitro groups.

In a particular embodiment, presence of a solublization group having a low pKa (e.g., less than 10, more preferably less than 7) facilitates reductive release of the inhibitors. Useful examples of acidic functional groups or salts thereof with an aqueous pKa of less than 10 include carboxylic acids, carboxylic salts, sulfonic acids, sulfonic acids, cyanamides, sulfonamides, hydroxlamic acids, thiols, thiolates, and the like. Most suitable are carboxylic acids, carboxylate salts, and sulfonic acids. The site of this solublization could be on substituents A, B, C or D which are not F-2, on the F-2 substituents (e.g., the $R^1$, $R^2$, $R^3$or L groups), or on the INH. In the most preferred embodiments of the invention, the solublization group, when present, is on either an A, B, C or D substituent or the INH in the form of a carboxylic acid moiety.

Mercaptothiazoles such as CMMT and its lower esters are especially preferred as INH groups for F-1 compounds in accordance with the invention, i.e. where INH is of the structure:

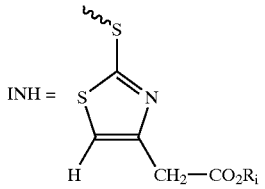

where $R_i$ is hydrogen or alkyl group of from 1–4 carbon atoms.

Where only one of the A, B, C, D substituents is of the structure F-2 (i.e., a mono INH-releasing quinone), a particularly preferred embodiment is where the meta and para positioned substituents (relative to the F-2 substituent) form a carbocyclic ring (most preferably a non-aromatic ring) and the ortho positioned substituent is a primary, secondary, or tertiary alkyl group, and the $R^3$ group of the F-2 substituent is a primary alkyl group.

Where two of the A, B, C, D substituents are of the structure F-2 (i.e., a bis INH-releasing quinone), they may be positioned ortho, meta, or para with respect to each other, but para positioning is preferred for ease of synthesis. The remaining A, B, C, D substituents preferably are primary, secondary, or tertiary alkyl groups, and the $R^3$ groups of the two F-2 substituents are preferably primary alkyl groups.

The presence of three or four F-2 groups is specifically contemplated, but less preferable for synthesis purposes.

The blocked image-modifying compounds of the present invention provide for the opportunity to specifically control the strength and location of image modification. They are also useful when incorporated in oligomeric or other polymeric species. Further, when such compounds unblock to form development inhibitors, excellent control of push processing, control of fog development, and control of specific layer developability can be obtained. These three applications can be realized by controlling the release rates. To control push processing, steady release upon extended processing is desirable; for control of fog development, gradual release during keeping is desirable; and for control of specific layer developability, rapid release upon processing is desirable.

One application of this technology may be to improve the color balance of reversal films. The reagent may be designed to not substantially affect development during normal processing time, but would upon extended development times (such as for push processing) reduce intralayer developability so as to match the developability of the other layers. These materials are stable when coated and at keeping pH. However, upon first developer processing (i.e., black and white development step in a color reversal process) they react with developers to gradually release the inhibitor. At longer processing times (such as during push processing) more inhibitor is released. Such control can be with regard to different color records, or with regard to different layers (for example, fast or slow) in the same color record. Further, the reduction of maximum density that typically occurs during push processing can be minimized.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain. alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acety1-N-dodecylamino, ethoxycarbonylamino, phenoxycarbonylamino, benzy oxycatbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-diprpylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcaramoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-compounds of formula F-1 which may be employed in the present invention include IRQ-1 through IRQ-46 shown below:

IRQ-1
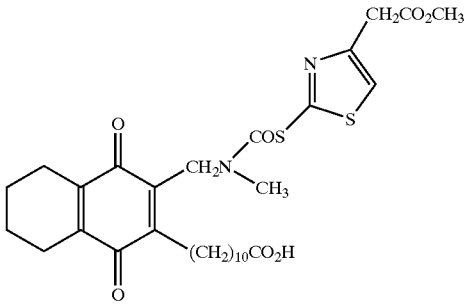
IRQ-2
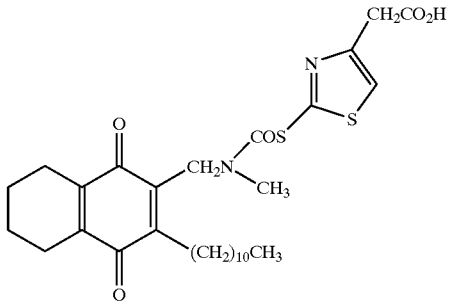
IRQ-3
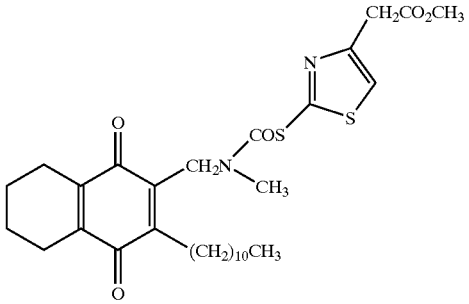
IRQ-4
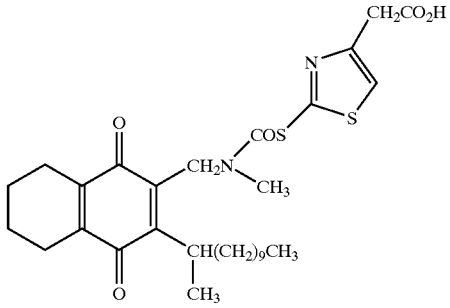
IRQ-5
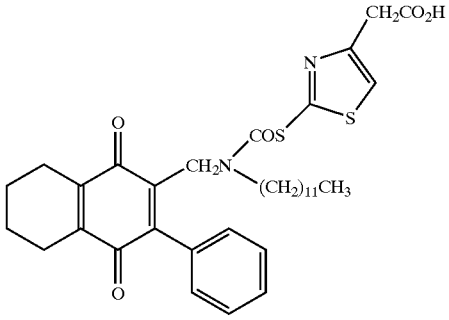
IRQ-6
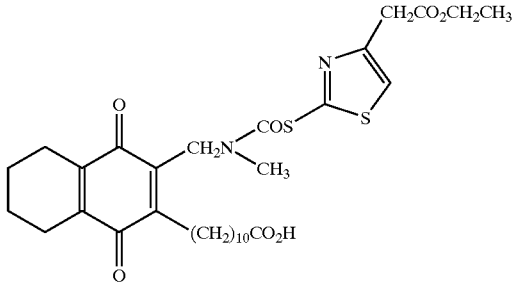
IRQ-7
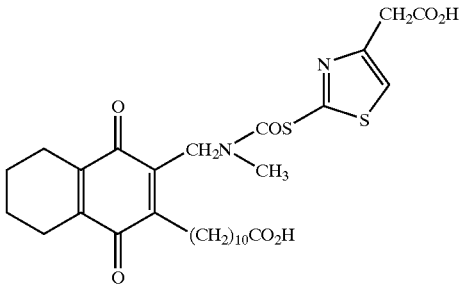
IRQ-8
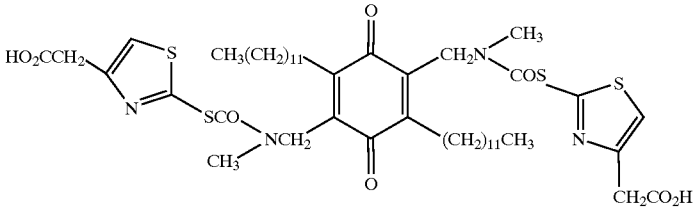

-continued
IRQ-9
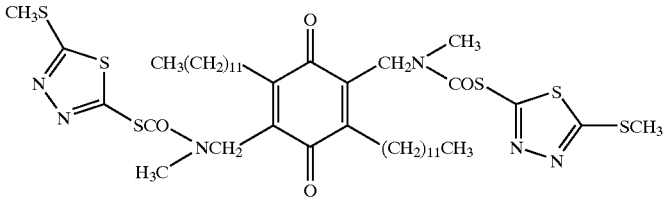
IRQ-10
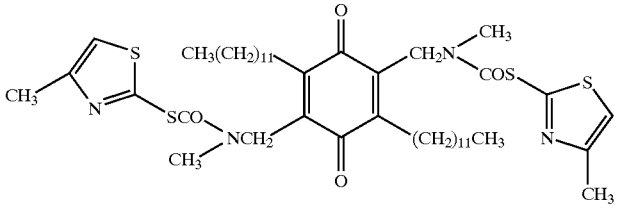
IRQ-11
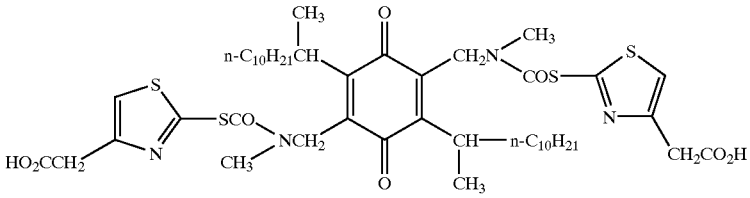
IRQ-12
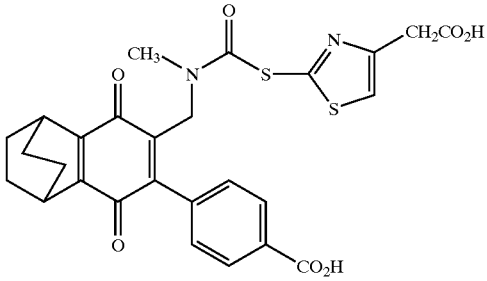
IRQ-13
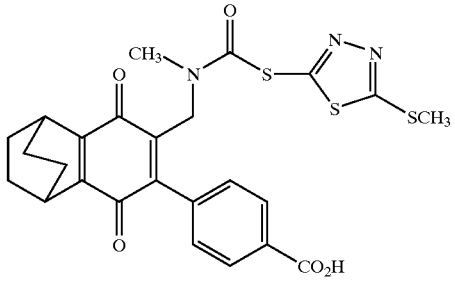
IRQ-14
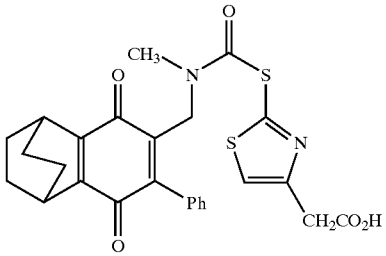
IRQ-15
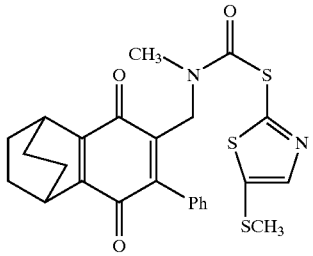
IRQ-16
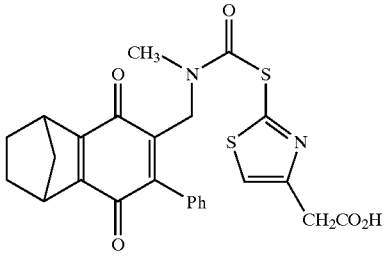
IRQ-17
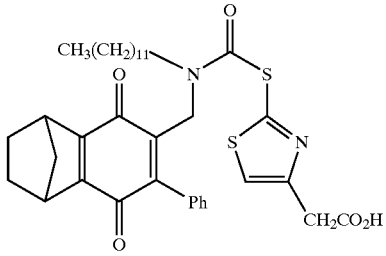

-continued
IRQ-18
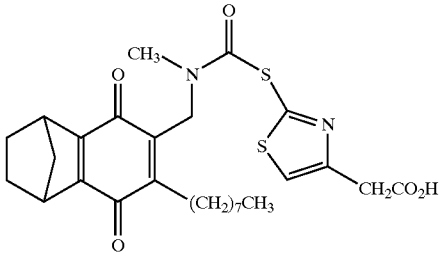
IRQ-19
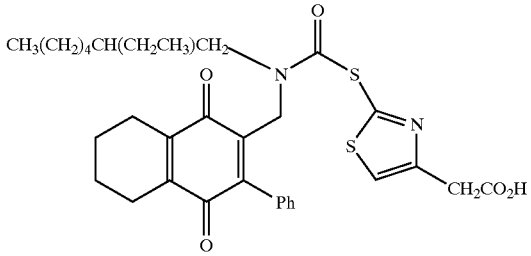
IRQ-20
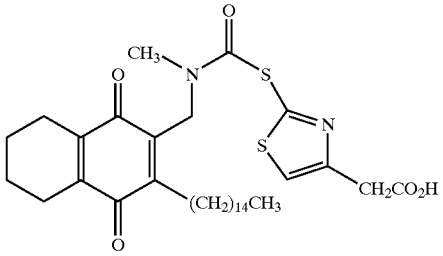
IRQ-21
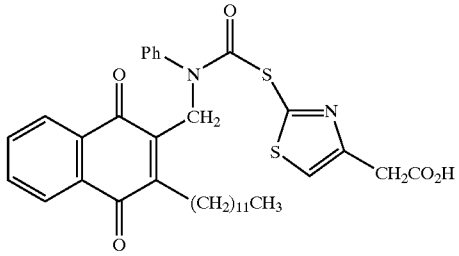
IRQ-22
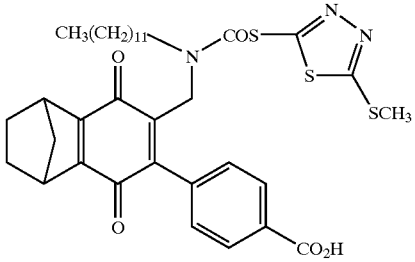
IRQ-23
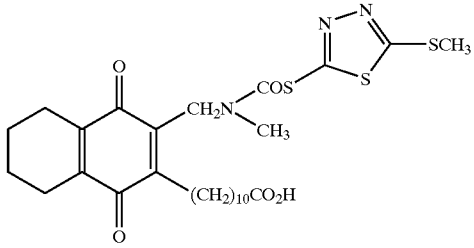
IRQ-24
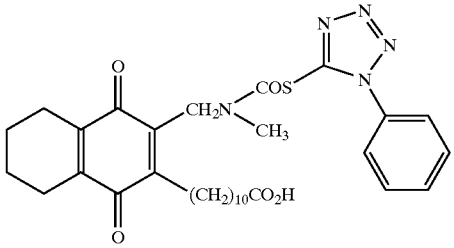
IRQ-25
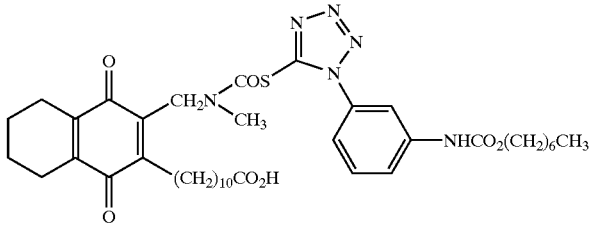
IRQ-26
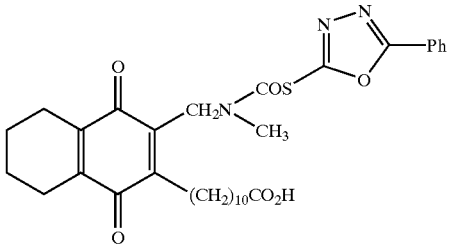
IRQ-27
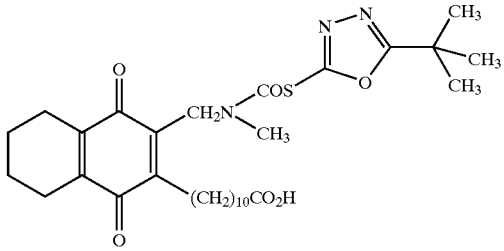
IRQ-28
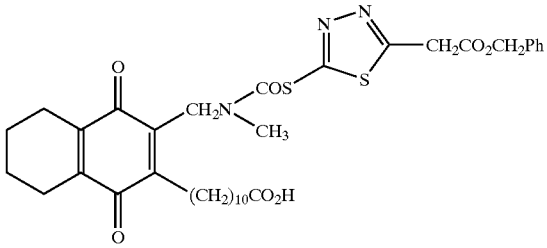
IRQ-29
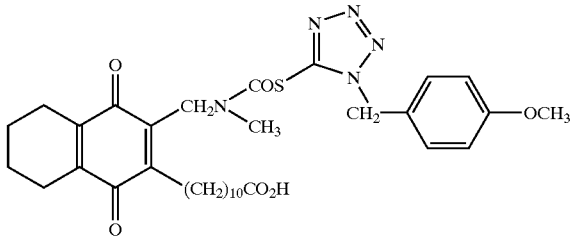

-continued
IRQ-30
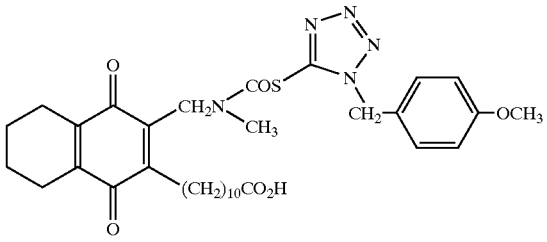
IRQ-31
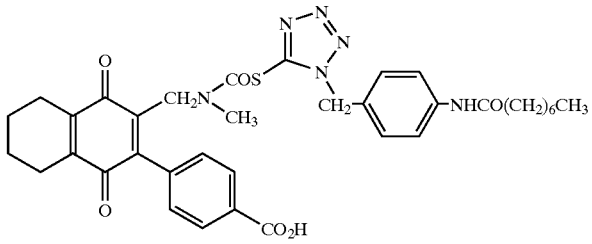
IRQ-32
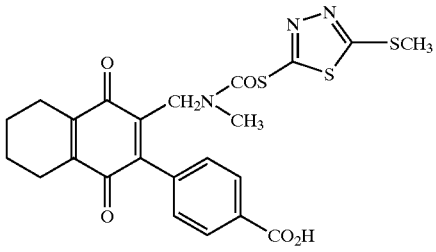
IRQ-34
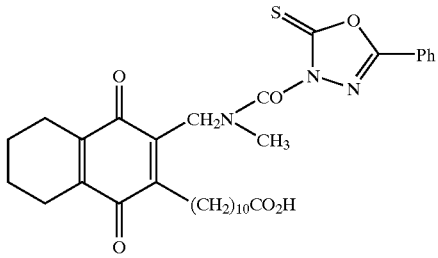
IRQ-35
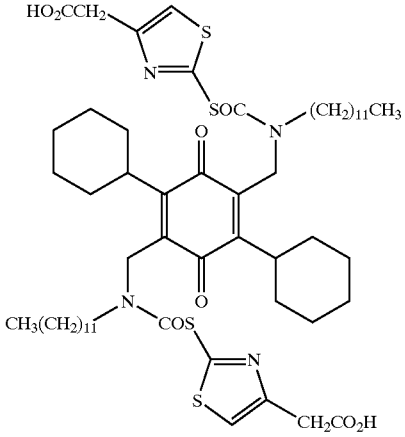
IRQ-36
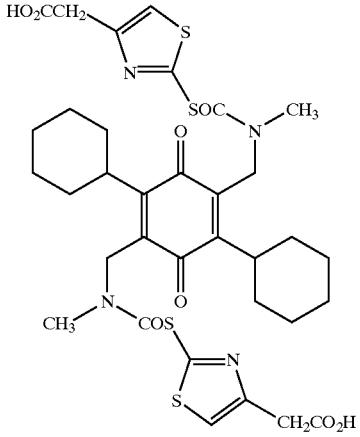
IRQ-37
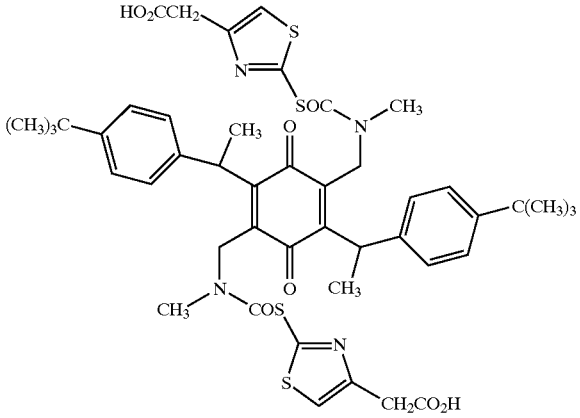

-continued
IRQ-38
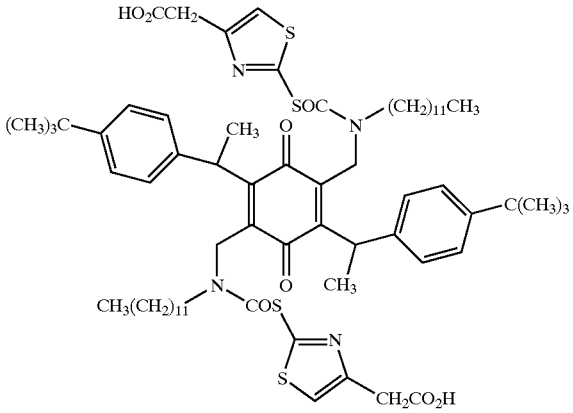
IRQ-39
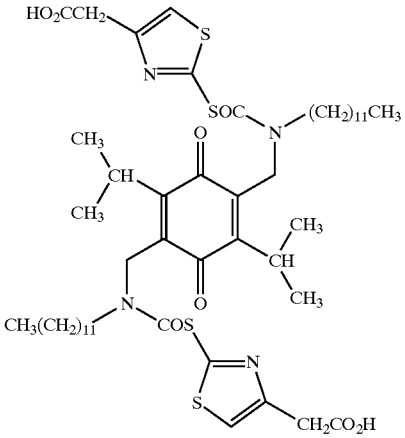
IRQ-40
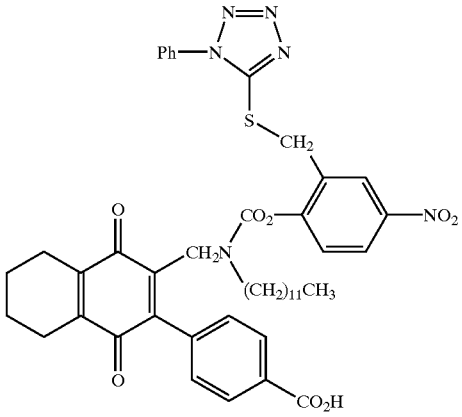
IRQ-41
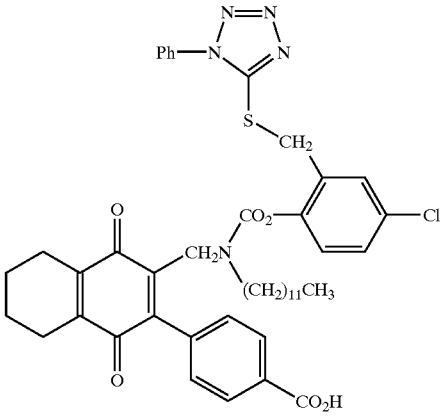
IRQ-42
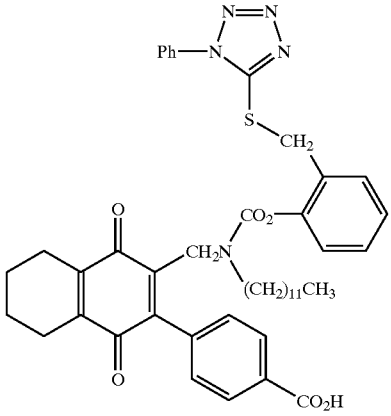
IRQ-43
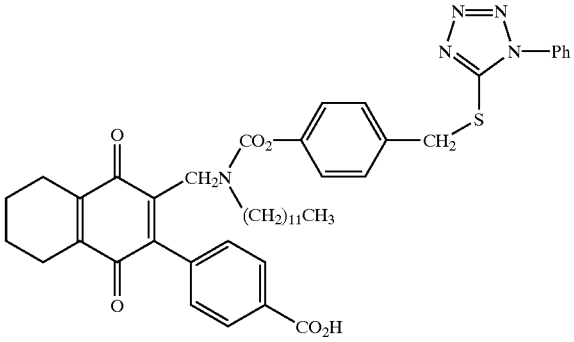

-continued

IRQ-44

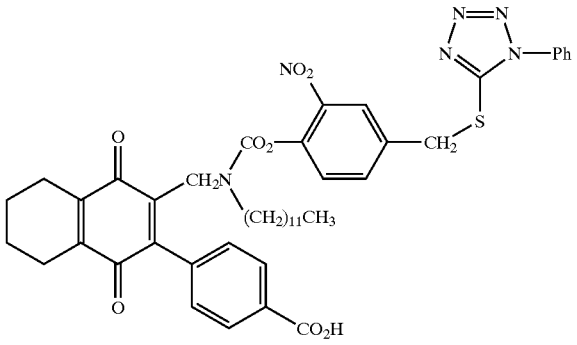

IRQ-45

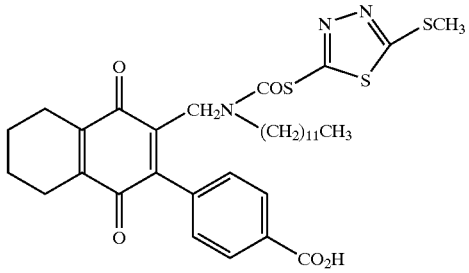

IRQ-46

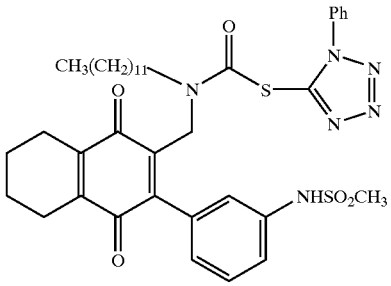

Generally, the IRQ compounds employed in elements of this invention can be made using conventional synthesis techniques, as illustrated in the synthetic examples below.

The photographic elements of the present invention are multilayer color reversal photographic elements. Multicolor elements typically contain dye image-forming units sensitive to each of the three primary regions of the visible light spectrum. Bach unit can be comprised of a single emulsion layer or of multiple emulsion layers sensitive to a given region of the spectrum. The layers of the element, including the layers of the image-forming units, can be arranged in various orders as known in the art. Dye-forming couplers may be incorporated into the emulsion layers, or may be introduced during processing (e.g., with standard published K-14 Kodachrome processing).

A typical coupler-incorporated multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Each silver halide emulsion unit can be composed of one or more layers and the various units and layers can be arranged in different locations with respect to one another. The element may contain additional layers, such as filter layers, interlayers, overcoat layers, subbing layers, and the like. The inhibitor releasing compounds of this invention can be incorporated in at least one of the silver halide emulsion layers and/or in at least one other layer, such as an adjacent layer. While it is an advantage of the invention that the use of inhibitor releasing quinone compounds of formula F-1 result in a lower speed penalty than that from conventional directly incorporated development inhibitors such as CMMT, such directly incorporated development inhibitors may be used in combination (in the same or different layers) with compounds of formula F-1 when desired.

Photographic emulsions are generally prepared by precipitating silver halide crystals in a colloidal matrix by methods conventional in the art. The colloid is typically a hydrophilic film forming agent such as gelatin, alginic acid, or derivatives thereof. The crystals formed in the precipitation step are washed and then chemically and spectrally sensitized by adding spectral sensitizing dyes and chemical sensitizers, and by providing a heating step during which the emulsion temperature is raised and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. Preferably, the emulsion is sensitized both with gold and a chalcogenide, most preferably gold and sulfur. Examples of sulfur sensitizers include sodium thiosulfate, alkyl or aryl thiourea compounds, or thiourea compounds with nucleophilic substituents as described in U.S. Pat. No. 4,810,626. Examples of gold sensitizers include potassium tetrachloroaurate, potassium dithiocyanato gold(I), trisodium dithiosulfato gold(I), and the gold(I) compounds described in U.S. Pat. Nos. 5,049,484; 5,049,485; 5,252,455; 5,220,030; and 5,391,727. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, bead coating, curtain coating and extrusion coating.

The compounds of this invention may be added to the silver halide emulsion at any time during the preparation of the emulsion, i.e., during precipitation, during or before chemical sensitization or during final melting and co-mixing of the emulsion and additives for coating. More preferably, these compounds are added during final melting and co-mixing of the emulsion and additives for coating.

Suitable levels of IRQ compounds of formula F-1 utilized in the present invention are about 0.02 to about 25 mmole/mole silver. Preferred levels are about 0.05 to about 15 mmole/mole silver. Most preferred levels are 0.1 to 2.0 mmole/mole silver.

The silver halide emulsion grains may be comprised of any halide combination, including silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferred are iodobromide emulsions with an iodide content of 2 to 12%.

The emulsions employed in the elements of this invention can include silver halide grains of any conventional shape or size (e.g., cubical, octahedral, dodecahedral, spherical or tabular) of silver halide grains. Specifically, the emulsions can include coarse, medium or fine silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an equal to the projected area of the grain. High aspect ratio tabular grain emulsions are specifically contemplated, such as those disclosed by Wilgus et al, U.S. Pat. No. 4,434,226, Daubendiek et al, U.S. Pat. No. 4,414,310, Wey, U.S. Pat. No. 4,399,215, Solberg et al, U.S. Pat. No. 4,433,048, Mignot, U.S. Pat. No. 4,386,156, Evans et al, U.S. Pat. No. 4,504,570, Maskasky, U.S. Pat. No. 4,400,463, Wey et al, U.S. Pat. No. 4,414,306, Maskasky, U.S. Pat. No. 4,435,501 and U.S. Pat. No. 4,643,966 and Daubendiek et al, U.S. Pat. No. 4,672 and U.S. Pat. No. 4,693,964, all of which are incorporated herein by reference. Also, specifically contemplated are those silver iodobromide grains with a higher molar proportion of iodide in the core of the grain than in the periphery of the grain, such as those described in British Reference No. 1,027,146; U.S. Pat. No. 4,379,837; U.S. Pat. No. 4,444,877; U.S. Pat. No. 4,665,012; U.S. Pat. No. 4,686,178 and U.S. Pat. No. 4,636,461 and in the European Reference No. 264,954, all of which incorporated herein by reference. The silver halide emulsions can be either monodisperse or polydisperse as precipitated. The grain size distribution of the emulsions can be controlled by silver halide grain separation techniques or be blending silver halide emulsions of differing grain sizes.

The grains can be contained in any conventional dispersing medium capable of being used in photographic emulsions. Specifically, it is contemplated that the dispersing medium be an aqueous gelatin-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

In the following Table, reference will be made to (1) Research Disclosure, December 1978, Item 17643, (2) Research Disclosure, December 1989, Item 308119, (3) Research Disclosure, September 1994, Item 36544, and (4) Research Disclosure, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing processing and manipulating the elements, and the images contained therein. Photographic elements and methods of processing such elements particularly suitable for use with this invention are described in Research Disclosure, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, morphology and |
| 2 | I, II, IX, X, XI, XII, XIV, XV | preparation. Emulsion preparation including |
| 3 & 4 | I, II, III, IX A & B | hardeners, coating aids, addenda, etc. |
| 1 | III, IV | Chemical sensitization and spectral |
| 2 | III, IV | sensitization/desensitization. |
| 3 & 4 | IV, V | |
| 1 | V | UV dyes, optical brighteners, |
| 2 | V | luminescent dyes. |
| 3 & 4 | VI | |
| 1 | VI | Antifoggants and stabilizers. |
| 2 | VI | |
| 3 & 4 | VII | |
| 1 | VIII | Absorbing and scattering materials, |
| 2 | VIII, XIII, XVI | Antistatic layers, Matting agents. |
| 3 & 4 | VIII, IX C & D | |
| 1 | VII | Image-couplers and image modifying |
| 2 | VII | couplers, Washout couplers, Dye |
| 3 & 4 | X | stabilizers and hue modifiers. |
| 1 | XVII | Supports |
| 2 | XVII | |
| 3 & 4 | XV | |
| 3 & 4 | XI | Specific layer arrangements. |
| 3 & 4 | XII, XIII | Negative working emulsions; Direct positive emulsions. |
| 2 | XVIII | Exposure. |
| 1 | XIX, XX | Chemical processing; |
| 2 | XIX, XX, XXII | Developing agents. |
| 3 & 4 | XVIII, XIX, XX | |
| 3 & 4 | XIV | Scanning and digital processing procedures. |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)). Such supports are described in further detail in Research Disclosure 3, Section XV. The photographic elements may also contain a transparent magnetic recording layer such as a layer containing magnetic particles on the underside of a transparent support. Magnetic layers have been described in U.S. Pat. No. 4,279,945 and U.S. Pat. No. 4,302,523, and *Research Disclosure*, November 1992, Item No. 34390, which are incorporated herein by reference. Typically, the element will have a total thickness (excluding the support) of from about 5 to about 30 microns.

The photographic elements may also contain additional materials that accelerate or otherwise modify the processing steps of bleaching or fixing to improve the quality of the image. Bleach accelerators described in European Patent Applications No. 193,389 and 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol and/or yellow and/or magenta filter dyes, either as oil-in-water dispersions, latex dispersions or as solid particle dispersions. Additionally, they may be used with "smearing" couplers (e.g. as described in U.S. Pat. No. 4,366,237; European Patent Application 96,570; U.S. Pat. No. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). IDIR compounds are disclosed, for example, in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

The silver halide grains to be used in the invention may be prepared according to methods known in the art, such as those described in Research Disclosure 3 and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in Research Disclosure 3 and the references cited therein.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in Research Disclosure, June 1975, item 13452 and U.S. Pat. No. 3,772,031.

The silver halide may be sensitized by sensitizing dyes by any method known in the art, such as described in Research Disclosure 3. Examples of dyes include dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

In a typical construction, a reversal film is distinguished from a color negative film in that it does not have any masking couplers. Furthermore, reversal films have a gamma generally between 1.5 and 2.0, a gamma which is much higher than the gamma for typical negative materials.

Photographic elements of the present invention can be imagewise exposed using any of the known techniques, including those described in Research Disclosure 3. This typically involves exposure to light in the visible region of the spectrum, and typically such exposure is of a live image through a lens. The photographic elements can be incorporated into exposure structures intended for repeated use or exposure structures intended for limited use, variously referred to as single use cameras, lens with film, or photosensitive material package units. However, the color reversal photographic elements of the present invention may alternatively be exposed in an electronic film writer. Exposure in a film writer is an exposure to a stored image (such as a computer stored image) by means of light emitting devices (such as light controlled by light valves, CRT, laser, laser diode, or some other controlled light source).

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6" or "K-14". A "color reversal" process in this context is one employing a first developer treatment with a non-chromogenic developer (that is, a developer which will not imagewise produce color by reaction with other compounds in the film; sometimes referenced as a "black and white developer"). Black and white developing agents which may be used in the first development include dihydroxybenzenes or derivatives thereof, ascorbic acid or derivatives thereof, aminophenol and 3-pyrazolidone type developing agents. Such black and white developing agents are well known in the art, e.g., U.S. Pat. Nos. 5,187,050, 5,683,859, 5,702,875. Preferred non-chromogenic developers are hydroquinones (such as hydroquinone sulphonate). The non-chromogenic development is followed by fogging unexposed silver halide, usually either chemically or by exposure to light. Then the element is treated with a color developer which will produce color in an imagewise manner upon reaction with other compounds (couplers), which may be incorporated in the film or introduced during processing. A wide variety of different color reversal processes are well known in the art. For example, a single color developing step can be used when the coupling agents are incorporated in the photographic element or three separate color developing steps can be used in which coupling agents are included in the developing solutions.

Preferred color developing agents are p-phenylenediamines. Especially preferred are: 4-amino N,N-diethylaniline hydrochloride; 4-amino-3-methyl-N,N-diethylaniline hydrochloride; 4-amino-3-methyl-N-ethyl-N-

(b-(methanesulfonamido)ethylaniline sesquisulfate hydrate; 4-amino-3-methyl-N-ethyl-N-(b-hydroxyethyl)aniline sulfate; 4-amino-3-b-(methanesulfonamido)ethyl-N,N-diethylaniline hydrochloride; and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in Research Disclosure 3. Standard commercial processing for reversal elements in accordance with the invention may preferably be utilized, including standard Kodak K-14 and Kodak E-6 processing.

EXAMPLES

Synthetic Scheme for Preparation of IRQ-1:

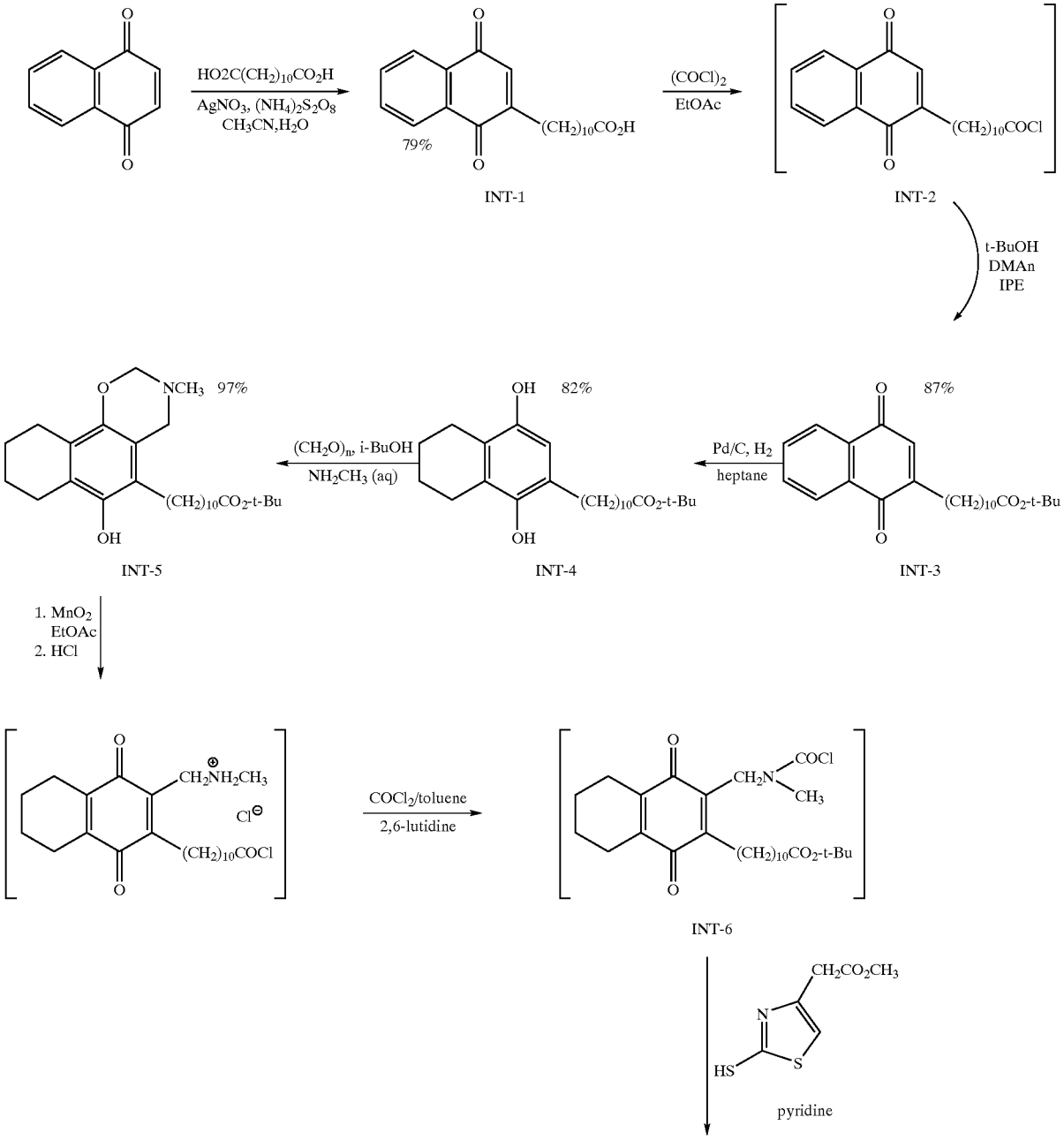

-continued

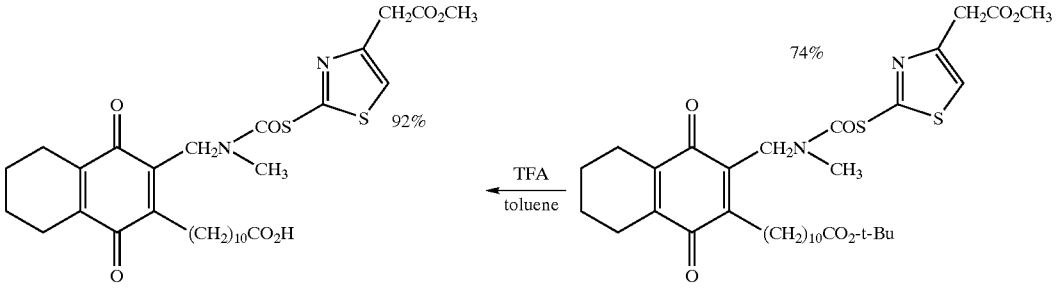

IRQ-1 INT-1

Preparation of INT-1: A mechanically stirred slurry of naphthoquinone (CAS 130-15-4; 1.76 kg, 11.1 mole; Aldrich Chemical Co.) and 1,12-dodecanedioic acid (CAS 693-23-2; 2.30 kg, 10.0 mole; Fluka Chemie AG., pulverized pellets) in a mixture of 6.0 L water and 2.0 L acetonitrile was warmed to 75° C. (internal temperature) employing a steam bath. Silver nitrate (128 g, 0.75 mole; Acros Chemical Co.) catalyst was added in a single portion to the warm mixture. A solution of ammonium persulfate (3.42 kg, 15.0 mole; Aldrich Chemical Co.) in 4.4 L water (solution temperature warmed to 22° C. to complete dissolution) was added dropwise to the warm slurry over about 3 hours. Over the period of the addition, the temperature was maintained between 76–80° C. Very rapidly after the addition of the persulfate solution was begun, gas evolution (carbon dioxide) was noted; this gas evolution became vigorous as the reaction proceeded. After the completion of the addition, reaction mixture was stirred and the temperature maintained between 76–80° C. until gas evolution ceased, after 75 minutes. The mixture was cooled to just below ambient temperature and the solid filtered, washed with water (ca. 16 L in portions) and briefly air dried. The damp, crude solid was triturated with 8 L acetonitrile for about 30 minutes then filtered. The solids were washed with portions of acetonitrile (4×1 L), then air dried briefly. This damp crude material was dissolved in 6 L refluxing ethyl alcohol. The filtrate was allowed to cool slowly overnight, the resulting nearly solid mixture was mechanically dispersed, then filtered, pressed using a rubber dam then washed with minimal cold 3A alcohol (3×400 mL). Vacuum drying under a slow nitrogen steam afforded UNT-1 as a yellow solid (2.69 kg, 79%) mp 108–110° C.

Preparation of INT-2: A mechanically stirred slurry of INT-1 (513 g, 1.50 mole) in 1.50 L ethyl acetate with a catalytic amount of DMF (1.5 mL) was treated dropwise over about 45 minutes with oxalyl chloride (165 mL, 240 g, 1.9 mole). With the addition of the oxalyl chloride, vigorous gas evolution from the reaction mixture became evident; after the addition, the resulting mixture was stirred at ambient temperature thirty minutes. An additional portion of DMF (1.5 mL) was cautiously added and the mix stirred a further thirty minutes at ambient temperature. The virtually homogenous reaction mixture was concentrated in vacuo on a rotary evaporator with the bath temperature held below 40° C. Heptanes were flashed off the residual solid (3×250 mL) to remove excess oxalyl chloride. This crude product, certainly containing residual amounts of heptanes, was used as is in the subsequent reaction in the scheme.

Preparation of INT-3: Crude acid chloride, INT-2, (crude product from oxalyl chloride reaction above; 1.50 mole) was suspended in 1.5 L of isopropyl ether then treated over about three minutes with a solution of t-butyl alcohol (300 mL, 3.2 mole) and N,N-dimethylaniline (300 mL, 2.4 mole). The stirred red mixture was heated to reflux over about 45 minutes then held there for two hours; the mixture was stirred at ambient temperature overnight. The mixture was poured into solution prepared by diluting 250 mL concentrated hydrochloric acid to approximately 1.5 L with ice and water; this was followed by the addition of 1.5 L of THF and 1.5 L ethyl acetate. The mixture was agitated then the layers were separated; the organic layer was washed with 500 mL portions of 10% aqueous hydrochloric acid and water. The combined aqueous layers were extracted with a further 400 mL ethyl acetate. Finally the organic layers were combined, dried with anhydrous sodium sulfate (400 g), filtered and concentrated in vacuo on a rotary evaporator; heptanes were flashed off (3×250 mL). The residual solid was dissolved in about 2.5 methanol and allowed to cool to ambient temperature overnight. The resulting semi-solid mass was mechanically broken up, then diluted with 500 mL methanol, stirred and vacuum filtered, pressed with rubber dam, washed with 250 mL cold methanol then finally air dried to afford INT-3 as a bright yellow solid (519 g, 87%), mp 66–68° C.

Preparation of INT-4: INT-3 (1007 g, 2.53 moles), 5% palladium on carbon (75 g) and 7.5 L heptanes were charged into a hydrogenation apparatus. This reaction vessel was purged with nitrogen then pressurized with hydrogen gas to about 600 psi. The pressurized mixture was shaken and heated externally to 55–65° C.; heating and agitation continued for 24 h with the hydrogen pressure generally maintained near 600 psi by addition of more hydrogen gas. After 24 h the temperature was reduced, the pressure vented and the resultant slurry was diluted with 5 L THF then warmed to 50° C. and agitated to ensure complete dissolution of the crystallized product. This mixture was filtered to remove the catalyst, washing the reaction vessel and solids with minimal THF to ensure complete transfer. The filtrate was concentrated in vacuo on a rotary evaporator to a thick oil; further heptanes (3×500 mL) were flashed off the residue affording a crude solid mass. This solid was triturated with 5.5 L low boiling ligroine, chilled with cold water (ca. 10° C.), filtered, washing with minimal (ca. 500 mL) cold 950 ligroine and air dried, under a nitrogen blanket to give INT-4 as a colorless solid (839 g, 82%), mp 67–70° C.

Preparation of INT-5: A slurry of paraformaldehyde (148 g, 4.92 mole as formaldehyde) in 1 L isobutyl alcohol was treated with aqueous methylamine (212 mL, 40% (w/w), 11.6 M; 2.46 mole) over about 2 minutes; a mildly exothermic reaction ensued, the internal reaction temperature rose to 40–450° C. After stirring 15 min at ambient temperature, INT-4 (828 g, 2.05 mole) was added at once, washing in with about 250 mL isobutyl alcohol (no exotherm was noted). This mix stirred at ambient temperature for 10 min then was heated to reflux over about thirty minutes. The reaction mixture refluxed under a Dean-Stark trap for 2.5 h. During this period about 150 mL of aqueous condensate was collected. As reflux continued the reaction solvent was allowed to distill out of the reaction mixture; over 45 minutes; the majority of the reaction solvent was removed (>1 L) and the internal reaction temperature rose to near 130° C. The amber solution was cooled, diluted with 3 L of aqueous ethyl alcohol (1:1 (v/v)) then chilled to allow solidification. The slurry stirred at reduced temperature for about 30 min then was filtered. The solids were pressed (rubber dam) at aspirator pressure, washed with 250 mL cold 1:1 aqueous ethyl alcohol then pulverized and air dried over 48 hours. INT-5 was obtained as a cream colored solid (917 g, 97%), mp 64–66° C.

Preparation of (crude) INT-6: A near solution of INT-5 (229.5g, 0.500mole) in 500 mL ethyl acetate was treated at once with activated manganese (IV) oxide (CAS 1313-13-9; 217.5 g, 2.50 mole). A mildly exothermic reaction ensued with the internal temperature eventually rising to 30–35° C. After one hour, the slurry was filtered through diatomaceous earth; the solids were wash with 250 mL ethyl acetate in portions. The filtrate was sequentially washed with 250 mL 10% hydrochloric acid and 250 mL water, then dried with sodium sulfate (250 g). The slurry was filtered, washing the solids with portions of ethyl acetate (ca. 250 mL total volume). The filtrate was treated with 2,6-lutidine (150 mL, 1.3 mole) then chilled to ca. 5° C. and treated over 30 min with a solution of phosgene in toluene (20% (w/w) 300 mL, 0.57 mole) such that the internal temperature remained at or below 18° C. This mix was stirred at reduced temperature for one hour. The reaction solution was decanted from the thick, pasty precipitate and filter through diatomaceous earth, the solids were washed with 250 mL ethyl acetate in portions. The combined filtrate was concentrated in vacuo, three portions of toluene (totaling 450 mL) were flashed off to afford crude INT-6.

Preparation of INT-7: The crude INT-6 (derived from the previous reaction sequence, ca. 0.500 mole) was dissolved in 500 mL pyridine then treated at once with methlyl 2-mercapto-4-thiazoleacetate (CAS 41714-97-0; 108.7 g, 0.575 mole). The resulting mixture was heated at 55–60° C. for ninety minutes. The reaction mixture was concentrated in vacuo with the residue partitioned between 1 L ethyl acetate/THF (1:1 (v/v)) and cold dilute acidic brine solution (150 mL concentrated hydrochloric acid plus 150 mL saturated brine diluted to 1 L with ice water). The organic layer was washed with 150 mL 10% hydrochloric acid. The combined aqueous washes were further extracted with 150 mL ethyl acetate. The combined organics were dried with sodium sulfate (400 g), filtered (washing with minimal ethyl acetate) and concentrated in vacuo. Heptanes were flashed off (450 mL in three portions) to provide a thick yellow-orange oil. The oil was triturated with 750 mL methyl alcohol overnight to allow thorough crystallization. The resultant slurry was chilled in an ice bath for an hour, filtered, washed with ice cold methyl alcohol (ca. 250 mL), pressed, then air dried to afford INT-7 as a bright yellow solid (245 g; 74%) mp 68–69° C.

Preparation of IRQ-1: A stirred slurry of INT-7 (240 g, 0.364 mole) in 350 mL toluene was treated over five minutes with 350 mL trifluoroacetic acid (4.54 mole). With the addition the reaction mixture's temperature initially fell slightly, then a mild exotherm was noted with the temperature finally reaching 30–35° C. The now homogenous mix was stirred at ambient temperature for two hours then concentrated in vacuo; portions of toluene (3×150 mL) were flashed off. The residue was dissolved in 750 mL propyl acetate; the solution was washed with two portions (250 mL) of 10% aqueous sodium acetate, then dried with sodium sulfate (250 g) and filtered, washing with minimal propyl acetate. The filtrate was diluted with of heptane (1 L), stirred to allow crystallization, then chilled in a ice bath for one hour. The cold slurry (ca. 5° C.) was filtered, the solids were washed with minimal cold 1:1 (v/v) propyl acetate/heptane, washed with low boiling ligroine (3×250 mL), then air dried to provide IRQ-1 as a bright yellow solid (202g, 92%), mp 82–83° C.

Preparation of Dispersion of IRQ-1: 1.0 g of IRQ-1 was dissolved in 2.0 g of N, N-Diethyllauramide and 3.0 g of ethyl acetate with gentle heating. This solution was then brought to a temperature of 40° C. and then mixed with a solution containing 3.0 g of pig gelatin and 0.3 g of the sodium salt of triisopropylnathphalene sulfonic acid dissolved in 40.7 g of distilled water. The resulting mixture was then passed through a colloid mill three times to produce a dispersion.

Photographic Example 1

Sample 101 (Invention): The following layers were coated in the following order onto a cellulose triacetate support subbed with gelatin using conventional coating techniques. In the composition of the layers, the coated amounts are given as g/m$^2$. Laydowns of silver halide are given relative to silver. Emulsion sizes as determined by the disc centrifuge method are reported in diameter x thickness in microns. IRQ-1 was incorporated in the slow magenta recording layer in the form of a dispersion prepared as described above.

| Layer 1: Antihalation Layer | |
|---|---|
| Black colloidal Silver | 0.25 |
| UV Dye UV-1 | 0.04 |
| UV Dye UV-2 | 0.06 |
| Dispersed in Solvent S-1 | 0.04 |
| Gelatin | 2.15 |

| Layer 2: Low speed Red Sensitive Layer | |
|---|---|
| Silver iodobromide emulsion<br>1.06 μm by 0.092 μm, 4% bulk iodide emulsion<br>spectrally sensitized with dyes SD-0 and SD-1 | 0.36 (as silver) |
| Fine Grain Silver Bromide<br>0.055 μm equivalent spherical diameter | 0.05 (as silver) |
| Cyan Coupler C-1 | 0.10 |
| Dispersed in Solvent S-3 | 0.05 |
| Gelatin | 1.07 |

| Layer 3: Medium Speed Red Sensitive Layer | |
|---|---|
| Silver Iodobromide Emulsion<br>0.85 μm by 0.090 μm, 4% bulk iodide,<br>spectrally sensitized with dyes SD-0 and SD-1 | 0.43 (as silver) |
| Fine Grain Silver Bromide<br>0.055 μm equivalent spherical diameter | 0.06 (as silver) |
| Cyan Coupler C-1 | 0.53 |
| Dispersed in Solvent S-3 | 0.20 |
| Gelatin | 0.94 |

| Layer 4: High Speed Red Sensitive Layer | |
|---|---|
| Silver Iodobromide Emulsion<br>1.18 μm by 0.111 μm, 3% bulk iodide,<br>spectrally sensitized with dyes SD-0 and SD-1 | 0.49 (as silver) |
| Fine Grain Silver Iodobromide<br>0.15 μm equivalent spherical diameter,<br>4.8% bulk iodide, spectrally sensitized with<br>dyes SD-0 and SD-1 | 0.03 |
| Fine Grain Silver Bromide | 0.065 |

-continued

| Layer 4: High Speed Red Sensitive Layer | |
|---|---|
| 0.055 μm equivalent spherical diameter | |
| Cyan Coupler C-1 | 0.77 |
| Dispersed in Solvent S-3 | 0.385 |
| Gelatin | 1.30 |

| Layer 5: First Interlayer | |
|---|---|
| Filter Dye FD-1 | 0.04 |
| SCV-1 | 0.16 |
| Dispersed in Solvent S-3 | 0.32 |
| Gelatin | 0.81 |

| Layer 6: Second Interlayer | |
|---|---|
| Carey Lea Silver | 0.002 |
| Gelatin | 0.81 |

| Layer 7: Low Speed Green Sensitive Layer | |
|---|---|
| Silver Iodobromide Emulsion | 0.45 (as silver) |
| 0.62 μm by 0.064 μm, 4% bulk iodide, spectrally sensitized with dyes SD-4 and SD-5 | |
| Fine Grain Silver Bromide | 0.10 (as silver) |
| 0.055 μm equivalent spherical diameter | |
| Magenta Coupler M-1 | 0.17 |
| Magenta Coupler M-2 | 0.07 |
| co-dispersed in Solvent S-2 | 0.12 |
| IRQ-1 | 0.014 |
| Dispersed with solvent S-4 | 0.028 |
| Gelatin | 1.10 |

| Layer 8: Medium Speed Green Sensitive Layer | |
|---|---|
| Silver Iodobromide Emulsion | 0.37 (as silver) |
| 0.96 μm by 0.065 μm, 3% bulk iodide, spectrally sensitized with dyes SD-4 and SD-5 | |
| Fine Grain Silver Bromide | 0.05 (as silver) |
| 0.055 μm equivalent spherical diameter | |
| Magenta Coupler M-1 | 0.33 |
| Magenta Coupler M-2 | 0.14 |
| Co-dispersed in Solvent S-2 | 0.235 |
| Gelatin | 0.87 |

| Layer 9: High Speed Green Sensitive Layer | |
|---|---|
| Silver Iodobromide Emulsion | 0.47 (as silver) |
| 1.18 μm by 0.111 μm, 3% bulk iodide, spectrally sensitized with dyes SD-4 and SD-5 | |
| Fine Grain Silver Iodobromide emulsion | 0.04 (as silver) |
| 0.15 μm equivalent spherical diameter, 4.8% bulk iodide spectrally sensitized with dyes SD-4 and SD-5 | |
| Magenta Coupler M-1 | 0.62 |
| Magenta Coupler M-2 | 0.27 |

-continued

| Layer 9: High Speed Green Sensitive Layer | |
|---|---|
| Co-dispersed in Solvent S-2 | 0.445 |
| Gelatin | 1.53 |

| Layer 10: Third Interlayer | |
|---|---|
| Gelatin | 0.61 |

| Layer 11: Fourth Interlayer | |
|---|---|
| Carey Lea Silver | 0.07 |
| SCV-1 | 0.11 |
| Dispersed in solvent S-3 | 0.22 |
| Gelatin | 0.68 |

| Layer 12: Low Speed Blue Sensitive Layer | |
|---|---|
| Silver Iodobromide Emulsion | 0.27 (as silver) |
| 1.47 μm by 0.135 μm, 3% bulk iodide, spectrally sensitized with dyes SD-6 and SD-7 | |
| Silver Iodobromide Emulsion | 0.27 (as silver) |
| 1.07 μm by 0.139 μm, 3% bulk iodide, spectrally sensitized with dyes SD-6 and SD-7 | |
| Fine Grain Silver Bromide | 0.07 (as silver) |
| 0.055 μm equivalent spherical diameter | |
| Yellow Coupler YEL-1 | 1.27 |
| Dispersed in Solvent S-3 | 0.42 |
| Gelatin | 1.89 |

| Layer 13: High Speed Blue Sensitive Layer | |
|---|---|
| Silver Iodobromide Emulsion | 0.22 (as silver) |
| 2.59 μm by 0.147 μm, 2% bulk iodide, spectrally sensitized with dyes SD-6 and SD-7 | |
| Silver Iodobromide Emulsion | 0.22 (as silver) |
| 1.86 μm by 0.133 μm, 2% bulk iodide, spectrally sensitized with dyes SD-6 and SD-7 | |
| Yellow Coupler YEL-1 | 0.85 |
| Dispersed in Solvent S-3 | 0.28 |
| Gelatin | 1.13 |

| Layer 14: Fifth Interlayer | |
|---|---|
| SCV-1 | 0.16 |
| Dispersed in solvent S-3 | 0.32 |
| Gelatin | 0.61 |

| Layer 15: First Overcoat | |
|---|---|
| Silver iodobromide emulsion | 0.09 (as silver) |
| 0.58 μm by 0.062 μm, 4% bulk iodide, spectrally sensitized with dyes SD-0 and SD-1 | |

-continued

| Layer 15: First Overcoat | |
|---|---|
| Fine Grain Silver Bromide<br>0.055 μm equivalent spherical diameter | 0.43 (as silver) |
| Gelatin | 0.81 |

| Layer 16: Second Overcoat | |
|---|---|
| UV Dye UV-4 | 0.41 |
| UV Dye UV-1 | 0.09 |
| Dispersed in Latex L-1 | 0.45 |
| Gelatin | 1.40 |

| Layer 17: Third Overcoat | |
|---|---|
| Matte<br>1.7 μm spherical diameter | 0.02 |
| Hardener H-1 | 1.38% of total gel |
| Gelatin | 0.97 |

The components employed for the preparation of light-sensitive materials not already identified above are shown below:

SCV-1:

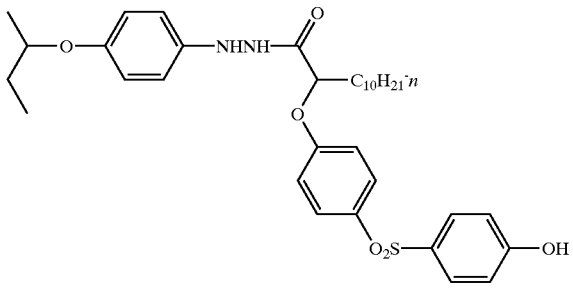

C-1:

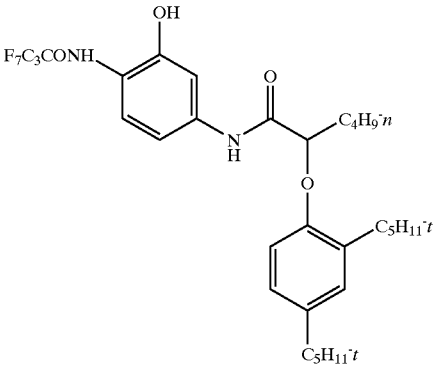

M-1:

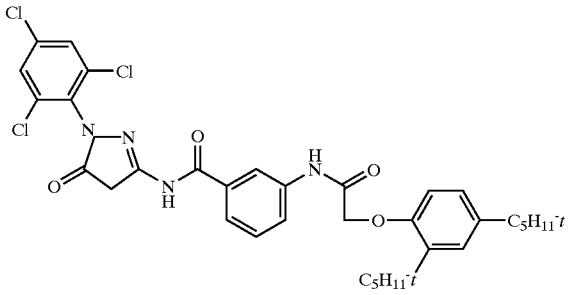

M-2:

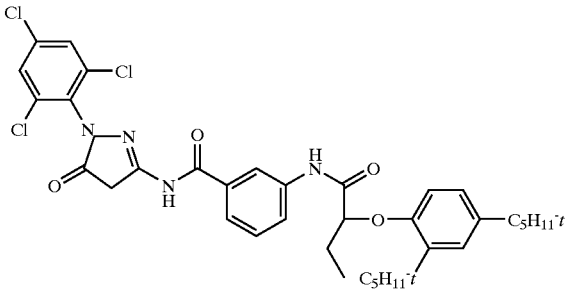

YEL-1:

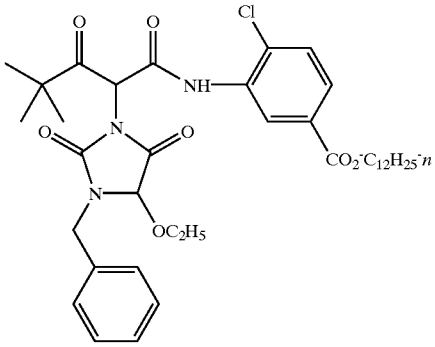

FD-1:

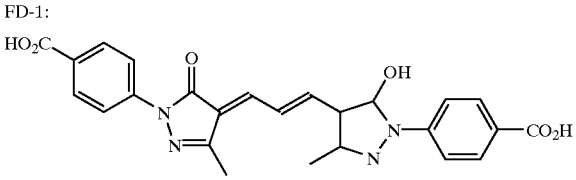

-continued
SD-0:
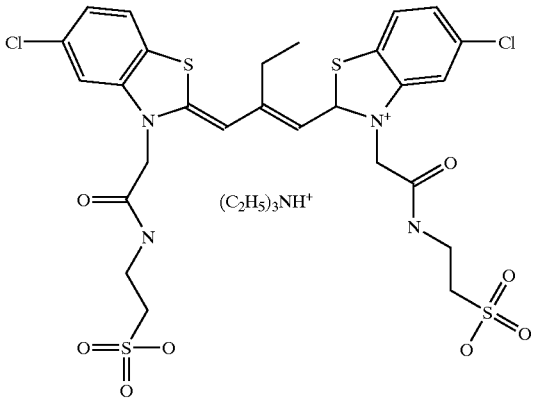
SD-1:
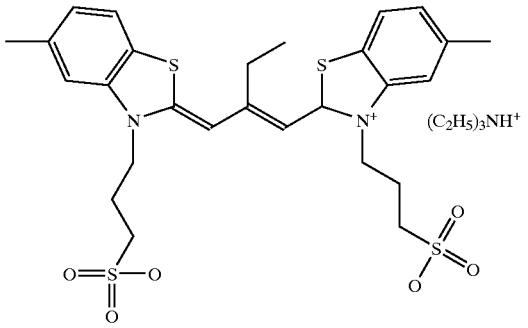
SD-4:
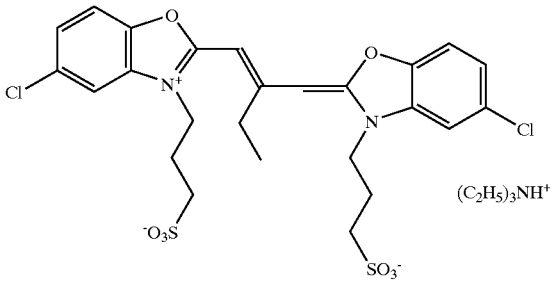
SD-5:
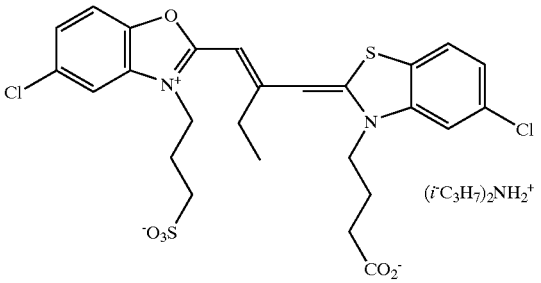
SD-6:
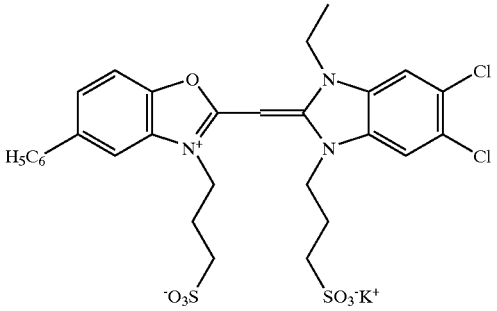
SD-7:
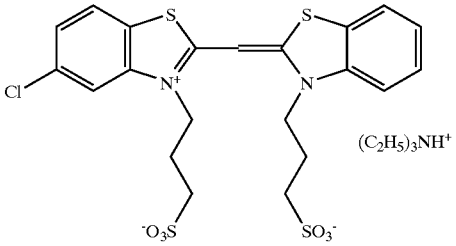
UV-1:
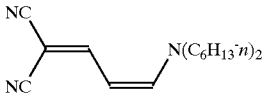
UV-2:
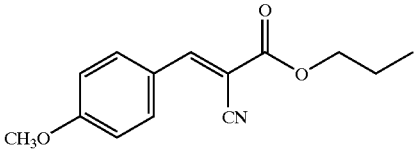
UV-4:
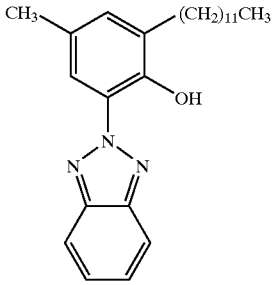
L-1:
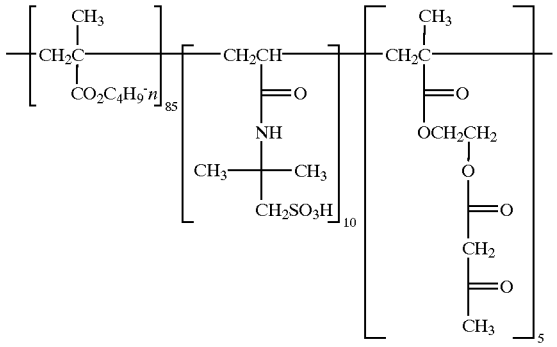

Hardener H-1:

1,1'-[methylenebis(sulfonyl)]bis-ethene

Solvent S-1

1,4-Cyclohexylenedimethylene bis(2-ethylhexanoate)

Solvent S-2

Phosphoric Acid, tris(methylphenyl) ester

Solvent S-3

1,2-benzenedicarboxylic acid, dibutyl ester

Solvent S-4

N,N-Diethyllauramide

Samples 102 to 108 were prepared in a similar fashion to Sample 101, except that IRQ-1 was replaced with the inhibitors as indicated below in the mounts shown in g/m$^2$.

Sample 102 (Invention): IRQ-2 at 0.013
Sample 103 (Invention): IRQ-3 at 0.013
Sample 104 (Invention): IRQ-4 at 0.013
Sample 105 (Invention): IRQ-5 at 0.013
Sample 106 (Invention): IRQ-6 at 0.014
Sample 107 (Comparative example): CMMT at 0.001
Sample 108 (Comparative example): no addenda The samples where than evaluated to determine the impact of the IRQ compounds on color modification via IIE effects, image sharpness, and photographic speed. Standard stepped sensitometric exposures to daylight-balanced white light were employed to measure speed differences between the coatings; speed differences measured at density equal to 0.5 are tabulated in Table 1 in CR units with 1.0 CR unit being equal to a difference of 0.01 log exposure relative to Sample 108. IIE effects were determined by exposing film to a red step exposure as well as to a uniform green flash exposure. The change in green density (at a flash level near D=1.0) with increasing red exposure was then measured. Increasing differences in green density change indicated higher levels of IIE; these data are also tabulated in Table 1. The sharpness of images recorded in each of the three color records of the test Samples was determined by measuring the acutance using standard power spectrum methods (represented as 8X loupe DMT's as described in *J. Soc. Photogr. Technol. Japan*, Vol. 62, No. 2, 1999, page 112), with higher acutance responses correlating with increased image sharpness. These data are summarized in Table 1. The speed and acutance data are presented as a difference from Sample 108 which contained no addenda. After exposing as described, all test Samples were developed employing standard Kodak E-6 color reversal processing solutions.

TABLE 1

| Sample | Inhibitor | Δ Speed (D = 0.5) | | | Red on Green IIE (D = 1.0) | Δ Acutance 8X loupe DMT | | |
|---|---|---|---|---|---|---|---|---|
| | | Red | Green | Blue | | Red | Green | Blue |
| 101 | IRQ-1 | −17 | −12 | −10 | 0.70 | 2.4 | 2.8 | 2.6 |
| 102 | IRQ-2 | −15 | −14 | −07 | 0.57 | 1.3 | 1.9 | 1.7 |
| 103 | IRQ-3 | −02 | −05 | −01 | 0.49 | 0 | 1.1 | 0.7 |
| 104 | IRQ-4 | −10 | −09 | −04 | 0.48 | 1.0 | 1.6 | 1.4 |
| 105 | IRQ-5 | −28 | −21 | −14 | 0.66 | 2.9 | 2.5 | 2.6 |
| 106 | IRQ-6 | −14 | −17 | −08 | 0.59 | 2.0 | 3.2 | 2.8 |
| 107 | CMMT | −31 | −21 | −14 | 0.74 | 2.5 | 1.9 | 2.1 |
| 108 | None (Check) | 0 | 0 | 0 | 0.41 | 0 | 0 | 0 |

From the data in Table 1 it is clear that the IRQ compounds of the invention greatly enhance the IIE and sharpness of the films relative to the comparative example Sample 108 which contains no addenda. More over, the IRQ compounds of the invention clearly provide such beneficial increases in IIE and sharpness with smaller attendant losses in photographic speed relative to the comparative example Sample 107 which contained CMMT.

To assess the relative merit of the IRQ compounds relative to the standard use of CMMT, a ratio of acutance improvement versus speed penalty was calculated for each color record (Δacutance×100/Δspeed). The higher this ratio the more acutance is obtain per unit speed loss; these ratios are arrayed in Table 2. It is clear from these data that the IRQ's afford improvements in image sharpness with a smaller speed disadvantage than obtained with CMMT. In virtually every color record where acutance improvements were noted, the IRQ compounds afforded a lower speed penalty.

TABLE 2

| Sample | Inhibitor | Δ Acutance × 100/Δ Speed | | |
|---|---|---|---|---|
| | | Red | Green | Blue |
| 101 | IRQ-1 | 14.1 | 23.3 | 12.0 |
| 102 | IRQ-2 | 8.6 | 13.6 | 5.7 |
| 103 | IRQ-3 | 0 | 22.0 | 10.0 |
| 104 | IRQ-4 | 10.0 | 17.7 | 17.5 |
| 105 | IRQ-5 | 10.3 | 11.9 | 10.7 |
| 106 | IRQ-6 | 14.3 | 18.8 | 21.2 |
| 107 | CMMT | 8.1 | 9.0 | 6.4 |

These data indicate the exceptional utility of the IRQ compounds in providing both color improving IIE's as well as dramatic improvements in image acutance. These improvements in photographic acutance, often surpassing those available from CMMT, were obtained with substantially smaller speed penalties than those encountered with the current commercial technology.

Photographic Example 2

For a reversal format, the blocked IRQ compounds of formula F-1 may be coated with appropriately sensitized silver iodobromide emulsions on a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl)amino) carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl) phenoxy)-acetyl)amino)-N-(4,5-dihydro-5-oxo-1-2,4,6-trichlorophenyl)-1H-pyrazol-3-yl)-; and containing the stabilizer 1,1'-Spirobi(1H-indene), 2,2',3,3'- tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)-phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

The invention has been described in detail with particular reference to certain preferred embodiments thereof, but it will be understood that variations and modifications can be effected within the spirit and scope of the invention.

We claim:

1. A multilayer color reversal photographic element comprising a support and at least two photographic silver halide emulsion layers and a compound of the formula F-1:

F-1

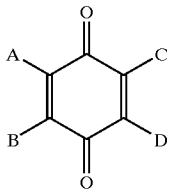

wherein A, B, C, and D are independently substituted or unsubstituted aliphatic, alicyclic, aromatic or heterocyclic substituents, which may where structurally possible together form a ring or rings; where at least one of A, B, C, and D is of the formula F-2:

F-2

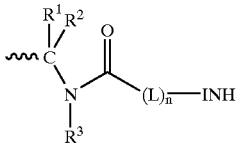

wherein $R^1$ and $R^2$ are independently either hydrogen or substituted or unsubstituted aliphatic, alicyclic, aromatic or heterocyclic substituents, which may where structurally possible form a ring with other substituents; $R^3$ is a substituted or unsubstituted aliphatic, alicyclic, aromatic or heterocyclic substituent which may where structurally possible form a ring with other substituents, L is a bivalent linking or timing group attached to the carbonyl moiety via a heteroatom; n varies from 0–2; and INH is a silver development inhibitor attached either to an L or the carbonyl moiety via a heteroatom.

2. An element according to claim 1, wherein $R^1$ and $R^2$ are hydrogen or lower alkyl groups of from 1 to 4 carbon atoms and $R^3$ is an alkyl group of from 1–12 carbon atoms for at least one F-2 substituent of the F-1 compound.

3. An element according to claim 2, wherein $R^3$ is a primary alkyl group.

4. An element according to claim 2, wherein the A, B, C and D substituents which are not of structure F-2 are independently alkyl or aryl groups of from 1–20 carbon atoms, or two of such groups combine together to form a non-aromatic ring.

5. An element according to claim 1, wherein NH comprises a mercaptotetrazole, selenotetrazole, mercaptobenzothiazole, selenobenzothiazole, mercaptobenzoxazole, selenobenzoxazole, benzotriazole, and benzodiazole, mercaptooxadiazole, mercaptothiadiazole, or mercaptothiazole compound.

6. An element according to claim 1, wherein NH is of the formula:

INH-1

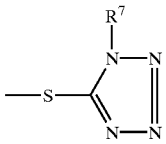

INH-2

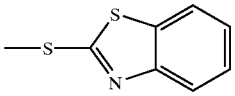

INH-3

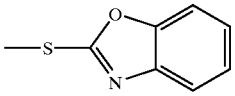

INH-4

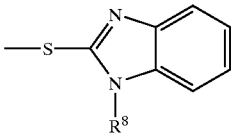

INH-5

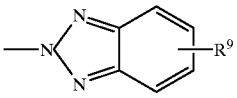

INH-6

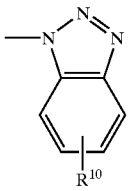

INH-7

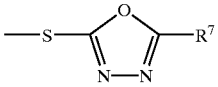

INH-8

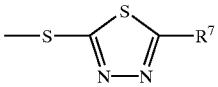

INH-9

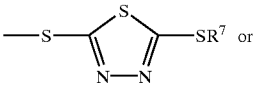

or

-continued

INH-10

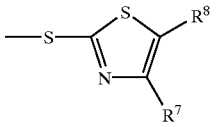

where $R^7$ and $R^8$ are individually hydrogen or a substituted or unsubstituted alkyl or phenyl group, and $R^9$ and $R^{10}$ are individually hydrogen or one or more halogen, alkyl, carboxyl, carboxy esters, —$NHCOOCH_3$, —$SO_2OCH_3$, —$OCH_2CH_2SO_2CH_3$, —$OC(O)OCH_2CH_3$, —$NHC(O)C(O)OCH_3$ or nitro groups.

7. An element according to claim 1, wherein the compound of formula F-1 comprises a solublization group having a pKa less than 10.

8. An element according to claim 7, wherein the solubilization group comprises a carboxylic acid, carboxylate salt, sulfonic acid, sulfinic acid, cyanamide, sulfonamide, hydroxamic acid, thiol, or thiolate.

9. An element according to claim 1, wherein INH is of the structure:

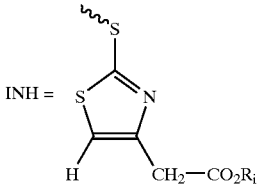

where $R_i$ is hydrogen or alkyl group of from 1–4 carbon atoms.

10. An element according to claim 1, wherein only one of the A, B, C, D sub stituents is of the structure F-2, and the meta and para positioned substituents relative to the F-2 substituent form a non-aromatic carbocyclic ring fused with the quinone ring.

11. An element according to claim 10, wherein the ortho positioned substituent relative to the F-2 substituent is a primary, secondary, or tertiary alkyl group, and the $R^3$ group of the F-2 substituent is a primary alkyl group.

12. An element according to claim 1, wherein at least two of the A, B, C, D substituents are of the structure F-2.

13. An element according to claim 12, wherein the two F-2 substituents are positioned para with respect to each other.

14. An element according to claim 1, where any remaining A, B, C, and D substituents which are not of structure F-2 are primary, secondary, or tertiary alkyl groups.

15. A process for developing a photographic element according to claim 1 after imagewise exposure, comprising subjecting the exposed element to a color reversal process comprising a first black and white development step which develop s a silver image in negative exposed areas, a reversal fogging step, and then development with a chromogenic developer to form a positive color image.

16. An element according to claim 1, wherein n=0.

17. An element according to claim 4, wherein n=0.

18. An element according to claim 9, wherein n=0.

19. An element according to claim 10, wherein n=0.

20. An element according to claim 7, wherein the solubilization group comprises a carboxylic acid moiety.

* * * * *

UNITED STATES PATENT AND TRADEMARK OFFICE

CERTIFICATE OF CORRECTION

PATENT NO. : 6,521,400 B1
DATED : February 18, 2003
INVENTOR(S) : Dannhauser et al.

It is certified that error appears in the above-identified patent and that said Letters Patent is hereby corrected as shown below:

Column 40,
Lines 11 and 19, change "NH" to -- INH --

Signed and Sealed this

Thirtieth Day of November, 2004

JON W. DUDAS
*Director of the United States Patent and Trademark Office*